US011479388B2

(12) United States Patent
Krieger et al.

(10) Patent No.: US 11,479,388 B2
(45) **Date of Patent: *Oct. 25, 2022**

(54) PACKAGING SYSTEM WITH SLIDABLE LATCH

(71) Applicant: Sonos, Inc., Santa Barbara, CA (US)

(72) Inventors: Dana Krieger, Santa Barbara, CA (US); Michelle Enright, Santa Barbara, CA (US); Matthew Ka-Ming Chung, Santa Barbara, CA (US); Stefan Reichert, Santa Barbara, CA (US); Jeremiah Robert Etchison, San Francisco, CA (US); Christopher George Palmer, Pleasanton, CA (US)

(73) Assignee: Sonos, Inc., Santa Barbara, CA (US)

( * ) Notice: Subject to any disclaimer, the term of this patent is extended or adjusted under 35 U.S.C. 154(b) by 545 days.

This patent is subject to a terminal disclaimer.

(21) Appl. No.: 16/418,544

(22) Filed: May 21, 2019

(65) Prior Publication Data

US 2019/0270548 A1 Sep. 5, 2019

Related U.S. Application Data

(63) Continuation of application No. 15/838,302, filed on Dec. 11, 2017, now Pat. No. 10,301,081, which is a (Continued)

(51) Int. Cl.

| | |
|---|---|
| ***B65D 43/12*** | (2006.01) |
| ***B65D 5/68*** | (2006.01) |
| ***B65D 5/64*** | (2006.01) |

(52) U.S. Cl.

CPC ..... *B65D 43/12* (2013.01); *B65D 5/643* (2013.01); *B65D 5/68* (2013.01); *B65D 2543/00537* (2013.01); *B65D 2543/00824* (2013.01)

(58) Field of Classification Search

CPC ..... B65D 43/12; B65D 43/20; B65D 43/22; B65D 2543/00824; B65D 5/643; (Continued)

(56) References Cited

U.S. PATENT DOCUMENTS 3,613,413 A * 10/1971 Glass et al. ..... E05B 37/16 70/298
4,807,759 A 2/1989 Castner
(Continued)

FOREIGN PATENT DOCUMENTS

DE 2458725 A1 6/1975
EP 1389853 A1 2/2004
(Continued)

OTHER PUBLICATIONS

AudioTron Quick Start Guide, Version 1.0, Mar. 2001, 24 pages.
(Continued)

*Primary Examiner* — Robert Poon

(57) ABSTRACT

An example packaging system includes a first box part with a first lid wall, the first lid wall including an aperture. The packaging system also includes a latch slidably disposed within the aperture, the latch having a body portion that extends perpendicularly into the first box part, where the latch is slidable in a direction parallel to the first lid wall. The packaging system also includes a second box part having a first tray wall, the first tray wall including a channel sized to slidably receive the latch, the channel including an assembly channel segment and a locking channel segment. When the first box part and the second box part are fitted together, a) the assembly channel segment is aligned with the latch when the latch is in a first position within the aperture, and b) the latch is slidable within the locking channel segment to a second position.

18 Claims, 8 Drawing Sheets

Related U.S. Application Data continuation of application No. 14/506,230, filed on Oct. 3, 2014, now Pat. No. 9,840,355.

(58) Field of Classification Search

CPC ..... B65D 5/68; B65D 5/6611; B65D 5/6647; B65D 5/6673; B65D 5/38; B65D 5/723; B65D 5/04; B65D 5/12; B65D 5/324; B65D 5/646; B65D 3/26; B65D 3/261; B65D 25/005; B65D 55/02; B65D 55/16; B65D 33/24

USPC .... 229/122, 125.19, 125.21, 125.37, 122.32; 220/23.89, 23.91, 324, 676, 315; 206/1.5, 206/758; 70/77, 63, 158, 162; 292/2, 32, 292/41, 35, 137, 138, 143

See application file for complete search history.

(56) References Cited

U.S. PATENT DOCUMENTS

| | | | | |
|---|---|---|---|---|
| 5,318,218 | A | 6/1994 | Mattson | |
| 5,440,644 | A | 8/1995 | Farinelli et al. | |
| 5,761,320 | A | 6/1998 | Farinelli et al. | |
| 5,923,902 | A | 7/1999 | Inagaki | |
| 6,032,202 | A | 2/2000 | Lea et al. | |
| 6,256,554 | B1 | 7/2001 | DiLorenzo | |
| 6,404,811 | B1 | 6/2002 | Cvetko et al. | |
| 6,469,633 | B1 | 10/2002 | Wachter et al. | |
| 6,522,886 | B1 | 2/2003 | Youngs et al. | |
| 6,611,537 | B1 | 8/2003 | Edens et al. | |
| 6,631,410 | B1 | 10/2003 | Kowalski et al. | |
| 6,757,517 | B2 | 6/2004 | Chang et al. | |
| 6,778,869 | B2 | 8/2004 | Champion | |
| 6,892,933 | B2 | 5/2005 | Sullivan et al. | |
| 7,130,608 | B2 | 10/2006 | Hollstrom et al. | |
| 7,130,616 | B2 | 10/2006 | Janik | |
| 7,143,939 | B2 | 12/2006 | Henzerling | |
| 7,236,773 | B2 | 6/2007 | Thomas | |
| 7,295,548 | B2 | 11/2007 | Blank et al. | |
| 7,391,791 | B2 | 6/2008 | Balassanian et al. | |
| 7,483,538 | B2 | 1/2009 | McCarty et al. | |
| 7,571,014 | B1 | 8/2009 | Lambourne et al. | |
| 7,604,156 | B2 | 10/2009 | Clohessy | |
| 7,630,501 | B2 | 12/2009 | Blank et al. | |
| 7,643,894 | B2 | 1/2010 | Braithwaite et al. | |
| 7,657,910 | B1 | 2/2010 | McAulay et al. | |
| 7,853,341 | B2 | 12/2010 | McCarty et al. | |
| 7,987,294 | B2 | 7/2011 | Bryce et al. | |
| 3,014,423 | A1 | 9/2011 | Thaler et al. | |
| 8,045,952 | B2 | 10/2011 | Qureshey et al. | |
| 8,103,009 | B2 | 1/2012 | McCarty et al. | |
| 8,234,395 | B2 | 7/2012 | Millington et al. | |
| 8,308,012 | B2 * | 11/2012 | Xin | B65D 5/32 220/324 |
| 8,483,853 | B1 | 7/2013 | Lambourne et al. | |
| 8,942,252 | B2 | 1/2015 | Balassanian et al. | |
| 2001/0042107 | A1 | 11/2001 | Palm | |
| 2002/0022453 | A1 | 2/2002 | Balog et al. | |
| 2002/0026442 | A1 | 2/2002 | Lipscomb et al. | |
| 2002/0124097 | A1 | 9/2002 | Isely et al. | |
| 2003/0102248 | A1 | 6/2003 | Lang et al. | |
| 2003/0157951 | A1 | 8/2003 | Hasty | |
| 2004/0024478 | A1 | 2/2004 | Hans et al. | |
| 2007/0142944 | A1 | 6/2007 | Goldberg et al. | |
| 2009/0229092 | A1 | 9/2009 | Xin | |
| 2009/0277131 | A1 | 11/2009 | Hung et al. | |
| 2012/0118892 | A1 * | 5/2012 | Kim | E05C 1/04 220/315 |
| 2015/0336712 | A1 * | 11/2015 | Taheri | B65D 25/10 220/23.91 |
| 2016/0107789 | A1 * | 4/2016 | Itano | B65D 5/32 206/386 |

FOREIGN PATENT DOCUMENTS

| | | |
|---|---|---|
| WO | 200153994 | 7/2001 |
| WO | 2003093950 A2 | 11/2003 |

OTHER PUBLICATIONS

AudioTron Reference Manual, Version 3.0, May 2002, 70 pages.
AudioTron Setup Guide, Version 3.0, May 2002, 38 pages.
Beeclip Box Clips Plastic Connecting Fasteners for Corrugated Boxes—BEE Packaging.
Bluetooth. "Specification of the Bluetooth System: The ad hoc SCATTERNET for affordable and highly functional wireless connectivity," Core, Version 1.0 A, Jul. 26, 1999, 1068 pages.
Bluetooth. "Specification of the Bluetooth System: Wireless connections made easy," Core, Version 1.0 B, Dec. 1, 1999, 1076 pages.
Dell, Inc. "Dell Digital Audio Receiver: Reference Guide," Jun. 2000, 70 pages.
Dell, Inc. "Start Here," Jun. 2000, 2 pages.
"Denon 2003-2004 Product Catalog," Denon, 2003-2004, 44 pages.
European Patent Office, European Office Action dated Feb. 8, 2018, issued in connection with EP Application No. 16002706.6, 4 pages.
European Patent Office, Extended Search Report dated Sep. 21, 2018, issued in connection with European Application No. 16002706.6, 6 pages.
European Patent Office, Extended Search Report dated Feb. 20, 2017, issued in connection with European Application No. 16002706.6, 6 pages.
First Action Interview Office Action dated Oct. 11, 2016, issued in connection with U.S. Appl. No. 14/506,230, filed Oct. 3, 2014, 11 pages.
International Searching Authority, International Search Report and Written Opinion dated Dec. 16, 2015, issued in connection with International Application No. PCT/US2015/053633, filed on Oct. 2, 2015, 10 pages.
Jo et al., "Synchronized One-to-many Media Streaming with Adaptive Playout Control," Proceedings of SPIE, 2002, pp. 71-82, vol. 4861.
Jones, Stephen, "Dell Digital Audio Receiver: Digital upgrade for your analog stereo," Analog Stereo, Jun. 24, 2000 retrieved Jun. 18, 2014, 2 pages.
Louderback, Jim, "Affordable Audio Receiver Furnishes Homes With MP3," TechTV Vault. Jun. 28, 2000 retrieved Jul. 10, 2014, 2 pages.
Non-Final Office Action dated Aug. 30, 2018, issued in connection with U.S. Appl. No. 15/838,302, filed Dec. 11, 2017, 12 pages.
Notice of Allowance dated Jan. 13, 2017, issued in connection with U.S. Appl. No. 14/506,230, filed Oct. 3, 2014, 7 pages.
Notice of Allowance dated Jun. 20, 2017, issued in connection with U.S. Appl. No. 14/506,230, filed Oct. 3, 2014, 5 pages.
Notice of Allowance dated Mar. 21, 2019, issued in connection with U.S. Appl. No. 15/838,302, filed Dec. 11, 2017, 7 pages.
Palm, Inc., "Handbook for the Palm VII Handheld," May 2000, 311 pages.
Preinterview First Office Action dated Jul. 28, 2016, issued in connection with U.S. Appl. No. 14/506,230, filed Oct. 3, 2014, 7 pages.
Presentations at WinHEC 2000, May 2000, 138 pages.
Restriction Requirement dated Jun. 1, 2018, issued in connection with U.S. Appl. No. 15/838,302, filed Dec. 11, 2017, 7 pages.
U.S. Appl. No. 60/490,768, filed Jul. 28, 2003, entitled "Method for synchronizing audio playback between multiple networked devices," 13 pages.
U.S. Appl. No. 60/825,407, filed Sep. 12, 2006, entitled "Controlling and manipulating groupings in a multi-zone music or media system," 82 pages.
UPnP; "Universal Plug and Play Device Architecture," Jun. 8, 2000; version 1.0; Microsoft Corporation; pp. 1-54.
Yamaha DME 64 Owner's Manual; copyright 2004, 80 pages.
Yamaha DME Designer 3.5 setup manual guide; copyright 2004, 16 pages.

(56) References Cited

OTHER PUBLICATIONS

Yamaha DME Designer 3.5 User Manual; Copyright 2004, 507 pages.

* cited by examiner

PACKAGING SYSTEM WITH SLIDABLE LATCH

CROSS REFERENCE TO RELATED APPLICATIONS

The present application is a continuation of U.S. application Ser. No. 15/838,302 filed on Dec. 11, 2017, which is a continuation of U.S. application Ser. No. 14/506,230 filed on Oct. 3, 2014, the disclosures of which are both explicitly incorporated by reference herein in their entirety.

FIELD OF THE DISCLOSURE

The disclosure is related to packaging systems and, more particularly, to systems, methods, features, and other elements directed to packaging systems including a sliding latch.

BACKGROUND

Packaging systems are commonly used to enclose products for distribution, storage, sale and use. Despite some of the typical objectives of packaging systems to protect and/or preserve the products that they contain, a packaging system may nonetheless be designed to be opened, so as to access the products inside.

There continues to be a need to develop packaging systems that are intuitive to use, easily re-usable, and efficient to assemble.

BRIEF DESCRIPTION OF THE DRAWINGS

Features, aspects, and advantages of the presently disclosed technology may be better understood with regard to the following description, appended claims, and accompanying drawings where:

Figure 1A:
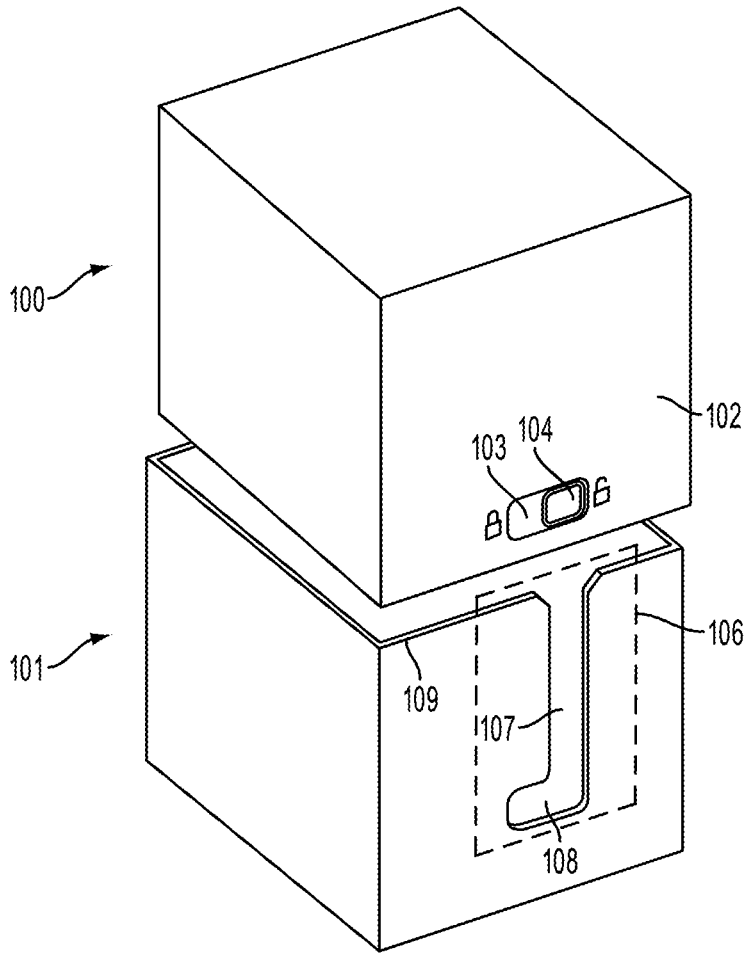
FIG. 1A shows a packaging system according to an example implementation.

The drawings are for the purpose of illustrating example implementation, but it is understood that the inventions are not limited to the arrangements and instrumentalities shown in the drawings. Further, the drawings are not drawn to scale.

DETAILED DESCRIPTION

I. Overview

Some examples described herein involve systems, methods, features, and other elements directed to packaging systems including a sliding latch. In particular, a packaging system may include a first box part having a number of walls, one or more of which may include an aperture with a latch that is slidable within the aperture. A second box part may also include a number of walls, one or more of which may include a channel sized to receive the latch. The second box part may be further configured to fit within the first box part such that the latch is aligned with the channel. Further, the latch may slide within the aperture, and within the channel when the box parts are fitted together, to a position where the latch may resist the separation of the box parts. Thus, the latch may be configured to "lock" the box parts together.

As indicated above, the examples involve packaging systems including a sliding latch. In one aspect, a packaging system is provided. The packaging system includes 1) a first box part including a plurality of lid walls, where a first lid wall includes an aperture; 2) a latch slidably disposed within the aperture; and 3) a second box part including a plurality of tray walls, where a first tray wall includes a channel sized to slidably receive the latch, where the channel includes an assembly channel segment and a locking channel segment, where the assembly channel segment intersects an edge of the first tray wall, where the second box part is configured to fit within the first box part such that a) the assembly channel segment is aligned with the latch when the latch is in a first position within the aperture, and b) the latch is slidable within the locking channel segment to a second position.

In another aspect, a method is provided. The method involves 1) fitting a second box part within a first box part, where the first box part includes a plurality of lid walls, where a first lid wall includes an aperture, where a latch is slidably disposed within the aperture, where the second box part includes a plurality of tray walls, where a first tray wall includes a channel sized to slidably receive the latch, where the channel includes an assembly channel segment and a locking channel segment, where the assembly channel segment intersects an edge of the first tray wall, and where the second box part is configured to fit within the first box part such that a) the assembly channel segment is aligned with the latch when the latch is in a first position within the aperture, and b) the latch is slidable within the locking channel segment to a second position; and 2) sliding the latch within the aperture to the second position, where sliding the latch within the aperture further includes sliding the latch within the locking channel segment.

In yet another aspect, a method is provided. The method involves 1) preparing a first blank for a first box part, the first box part including a plurality of lid walls, where a first lid wall includes an aperture; 2) preparing a second blank for a second box part, the second box part including a plurality of tray walls, where a first tray wall includes a channel sized to slidably receive the latch, where the channel includes an assembly channel segment and a locking channel segment, where the assembly channel segment intersects an edge of the first tray wall; 3) disposing a latch within the aperture such that the latch is slidable within the aperture; 4) forming the first box part from the first blank; and 5) forming the second box part from the second blank, where the formed second box part is configured to fit within the formed first box part such that a) the assembly channel segment is aligned with the latch when the latch is in a first position within the aperture, and 2) the latch is slidable within the locking channel segment to a second position.

It will be understood by one of ordinary skill in the art that this disclosure includes numerous other implementations. While some examples described herein may refer to functions performed by given actors such as "users" and/or other entities, it should be understood that this description is for purposes of explanation only. The claims should not be interpreted to require action by any such example actor unless explicitly required by the language of the claims themselves.

II. Example Packaging Systems

As discussed above, examples described herein may involve systems, methods, features, and other elements directed to packaging systems including a sliding latch.

Figure 4:
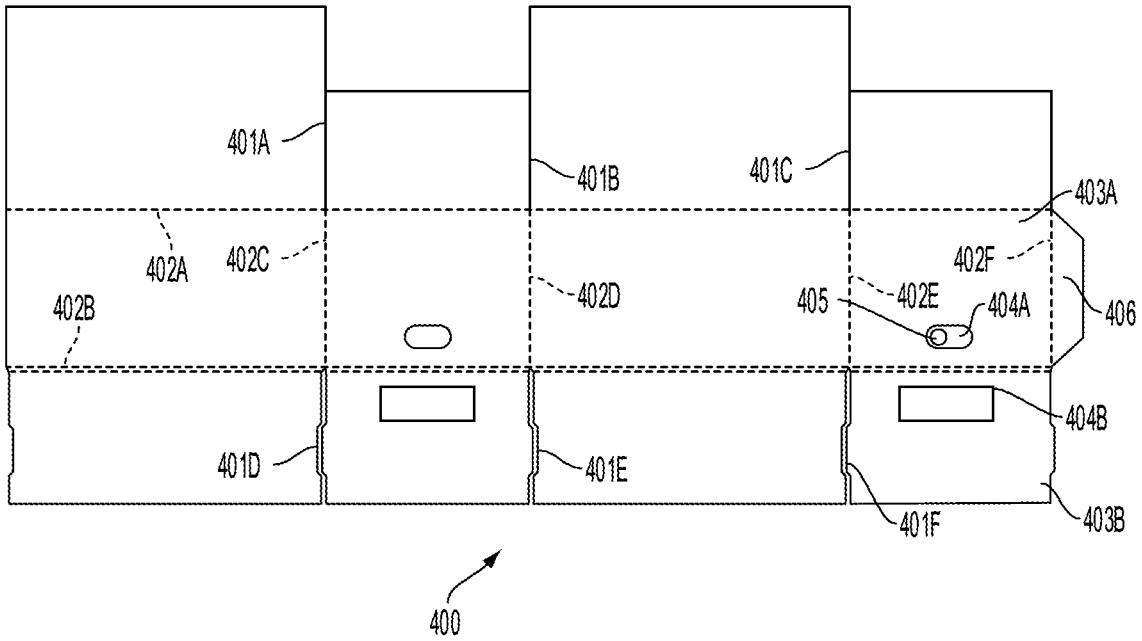
FIG. 4 shows a first blank for a first box part according to an example implementation.
Figure 5:
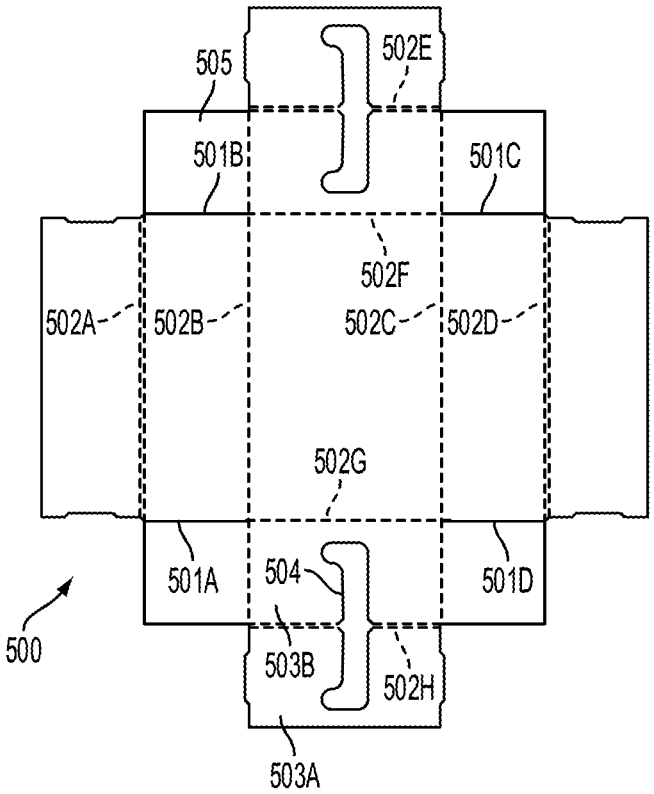
FIG. 5 shows a second blank for a second box part according to an example implementation.
Figure 6:
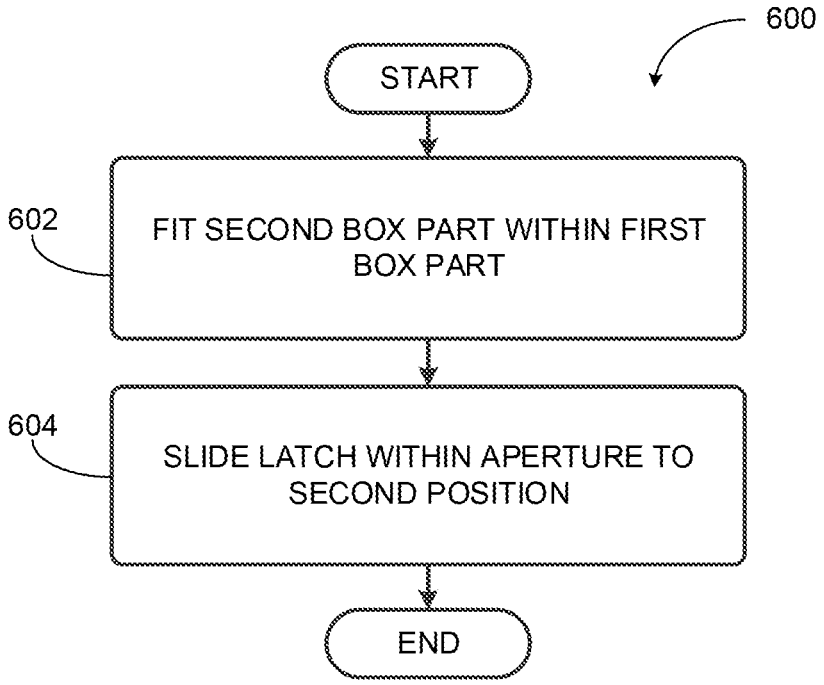
FIG. 6 shows a flow diagram according to an example implementation.
Figure 7:
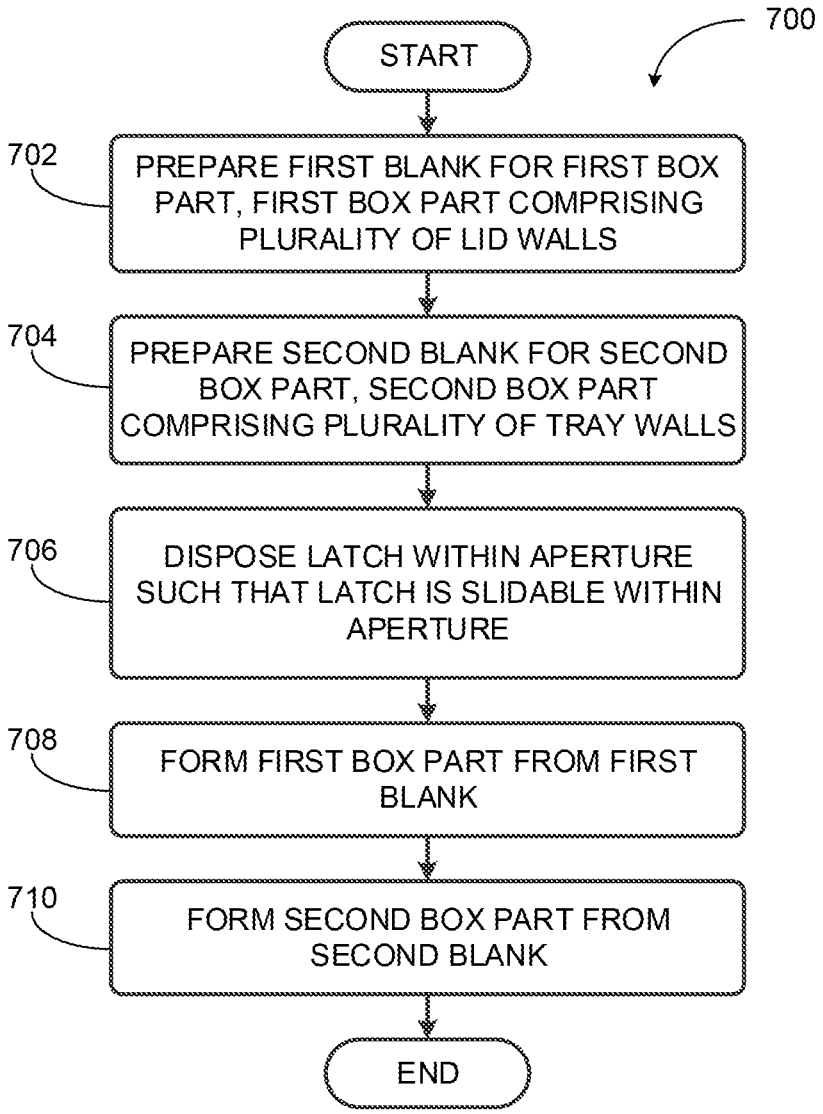
FIG. 7 shows a flow diagram according to an example implementation.

For clarity, the methods 600 and 700 shown in FIGS. 6 and 7 may be described herein with reference to FIGS. 1A, 1B, 2A, 2B, 3, 4, and 5. It should be understood, however, that this is for purposes of example and explanation only and that the operations of the methods should not be limited by these figures. Methods 600 and 700 may include one or more operations, functions, or actions as illustrated by one or more of the blocks in each figure. Although the blocks are illustrated in sequential order, these blocks may also be performed in parallel, and/or in a different order than those described herein. Also, the various blocks may be combined into fewer blocks, divided into additional blocks, and/or removed based upon the desired implementation.

FIG. 1A shows a first box part 100 of an example packaging system. The box may be, for example, paper, paperboard, cardboard, fiberboard, or the like. It may be corrugated, uncorrugated, or a combination thereof. Alternatively, the first box part 100 may be plastic. Other examples are also possible.

The first box part may include a plurality of lid walls. For example, the first box part 100 shown in FIG. 1A is shown as a cube, however numerous other shapes (e.g., cuboid, pyramid, cylinder, etc.) with different configurations and/or different numbers of walls are also possible. Further, the first box part might not include walls on each of its sides, such that the box is fully enclosed. That is, the first box part may have one or more sides that do not include a wall. For example, the cube-shaped first box part 100 shown in FIG. 1A may consist of only five lid walls. Instead of a sixth wall on the bottom of the first box part 100, there may be an opening. Other examples and configurations are also possible.

A first lid wall 102 of the first box part 100 may include an aperture 103. Further, a latch 104 may also be slidably disposed within the aperture 103. The latch 104 may further include a body portion that extends into the first box part 100, which may be seen more clearly in FIGS. 2A and 2B.

In some cases, as shown in FIG. 1A, the latch 104 may be slidable within the aperture 103 along a single axis. For example, as shown in FIG. 1A, the latch 104 may be slidable horizontally, to the left and right. In other examples, the aperture 103 may have a shape that includes more than one axis, such as an "L" or a "T" shape, among other shapes. Accordingly, the latch 104 may be slidable within the aperture 103 along a plurality of axes. The aperture 103 may additionally or alternatively include one or more arc segments such that the latch 104 slidable within the aperture 103 along a curve. Other possibilities exist.

The example packaging system may also include a second box part 101 including a plurality of tray walls including any of the materials, shapes, or configurations discussed above. As shown in FIG. 1A, the second box part 101 includes five tray walls that generally define a cube with an open top. A first tray wall 105 of the second box part 101 may include a channel 106 sized to slidably receive the latch 104, including the body of the latch 104 that may extend into the second box part 101. The channel 106 may include an assembly channel segment 107 and a locking channel segment 108. Further, the assembly channel segment 107 may intersect an edge 109 of the first tray wall 105.

As shown in FIG. 1A, the channel segments are complete cut-outs from the first tray wall 105. However, in some implementations the channel segments may instead be a depression or a groove in the first tray wall 105, among other arrangements. For example, in some cases the first tray wall 105 may be multi-layered such that its cross-section is composed of two or more adjacent walls. In such a case, one or both channel segments 107, 108 may include a cut-out of some but not all of the layers in the first tray wall 105. Other examples are also possible.

In FIG. 1A, the assembly channel segment 107 is chamfered such that it has a first width at the edge 109 of the first tray wall 105, and a second, smaller width away from the edge 109 of the first tray wall 105. This widening of the assembly channel segment 107 where it intersects the edge 109 of the first tray wall 105 may facilitate the proper alignment of the latch 103 into the assembly channel segment 107 when the box parts are fitted together. Other geometric examples the may widen the assembly channel segment 107 at the edge 109, such as filleted corners, are also possible.

The second box part 101 may be configured to fit within the first box part 100 such that the assembly channel segment 107 is aligned with the latch 104 when the latch 104 is in a first position within the aperture 103. As shown in FIG. 1A, the latch 104 is on the right side of the aperture 104 where it is aligned with the assembly channel segment 107. On the first lid wall 105, near the right side of the aperture 103, is an icon indicating that the latch is "unlocked" when it is in this first position.

Accordingly, in the example method 600 shown in FIG. 6, block 602 may involve fitting the second box part 101 within the first box part 100, as discussed above. Alternatively, in some implementations, the first box part 100 may be configured to be fitted within the second box part 101.

Figure 1B:
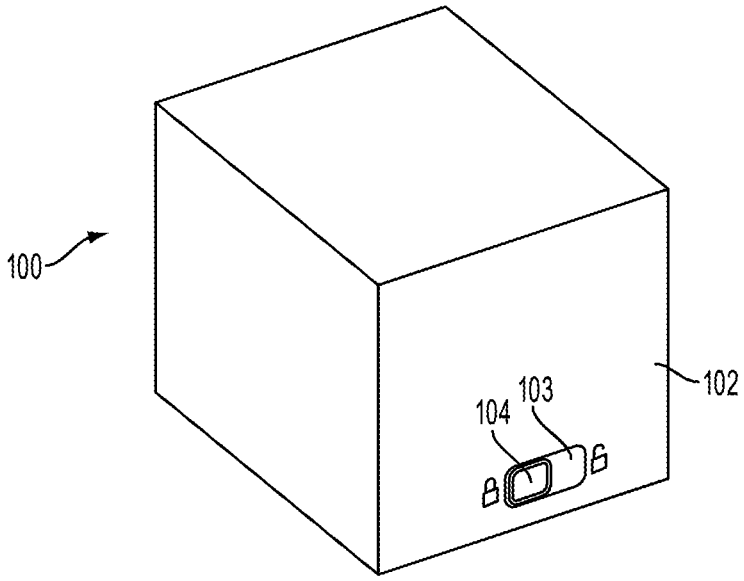
FIG. 1B shows a packaging system according to an example implementation.

When the second box part 101 is fitted within the first box part 100 as discussed above, the aperture 103 may be substantially aligned with the locking channel segment 108. Thus, the latch 104 may be slidable not only within the aperture 103, but also within the locking channel segment 108 to a second position. In FIG. 1B, the second box part 101 is within the first box part 100 and is no longer shown. Further, the latch 104 has been slid to the left side of the aperture 104 such that it is no longer aligned with the assembly channel segment 107. In this position, the body of latch 104 that extends into the second box part 101 may resist the separation of the box parts by via contact with the first tray wall 105. Accordingly, on the first lid wall 105, near the left side of the aperture 103, is an icon indicating that the latch 104 is "locked" when it is in this second position.

Accordingly, block 604 of the method 600 may involve sliding the latch within the aperture to the second position, where sliding the latch within the aperture also includes sliding the latch within the locking channel segment.

In some examples, as discussed above, the aperture 103 may include more than one line or arc segment, and the latch 104 may be slidable within the aperture 103 along more than one axis. In such cases, the locking channel segment 108 may include a corresponding configuration of line or arc segments, and the latch 104 may be further slidable within the locking channel segment 108.

Although the first box part 100 in FIGS. 1A-1B is generally referred to herein as the "lid" and the second box part 101 is generally referred to as the "tray", this is for purposes of example and explanation only. These labels may be orientation-dependent and describe one of many possible configurations. In some implementations, the first box part 100 and the second box part 101 may be a "right side" and "left side", and may be fitted together horizontally instead of vertically. Moreover, in some examples, the first box part 100 and the second box part 101 may not be separable components as shown in FIG. 1A. Rather, they may be two parts of a single, integral packaging system. For example, the first box part 100 may be a flap that is attached to, and slides into or over, the second box part 101. Other examples are also possible.

Figure 2A:
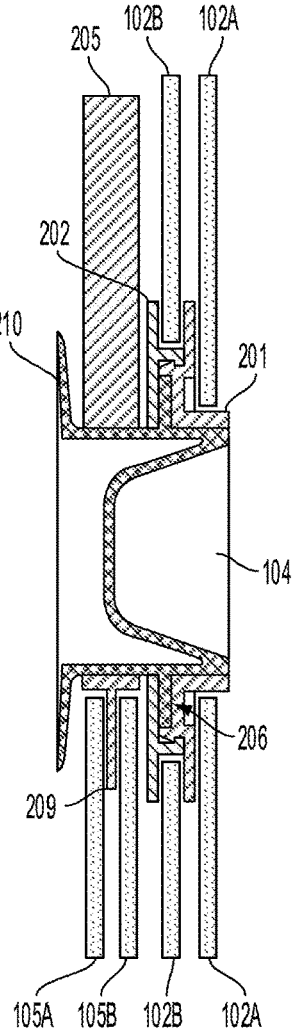
FIG. 2A shows cross-sectional view of a packaging system according to an example implementation.
Figure 2B:
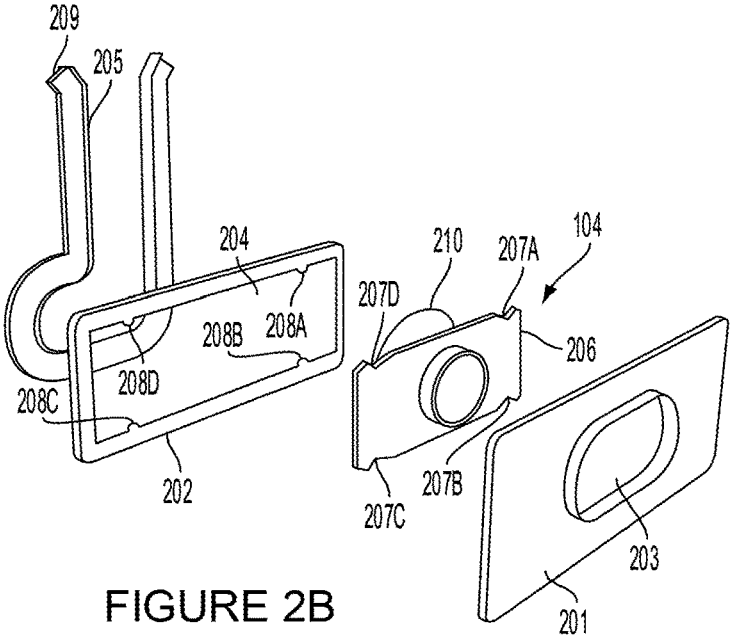
FIG. 2B shows an exploded view of a packaging system according to an example implementation.

In some examples, the first lid wall 102 may further include an assembly surrounding the aperture 103 and housing the latch 104. For example, as shown in FIGS. 2A and 2B, the first lid wall 102 may include a front plate 201 and a back plate 202, each including a respective aperture 203 and 204. The front plate 201 and back plate 202 may be substantially parallel with the first lid wall 102, and may be coupled together such that the aperture 103 of the first lid wall 102, the aperture 203 of the front plate 201, and the aperture 204 of the back plate 202 are all substantially aligned.

FIG. 2A shows a cross-sectional view of the first lid wall 102. In this example, the first lid wall 102 includes two adjacent walls—an outside wall 102A and an inside wall 102B. Further, the latch 104 includes a slide flange 206 that is also substantially parallel with the first lid wall 102 and slidably contained within a cavity between the front plate 201 and the back plate 202. FIG. 2B shows an exploded view of the front plate 201, the latch 104, and the back plate 202. For clarity, the outside wall 102A and the inside wall 102B are not shown in FIG. 2B.

The front plate 201 and back plate 202 may be coupled together via glue, mechanical fasteners, or as a result of their integration into the first lid wall 102. Other examples are also possible. As shown in FIG. 2A, the front plate 201 is disposed in between the inside wall 102A and the outside wall 102B. Further, the back plate 202 is disposed such that the inside wall 102B is between the front plate 201 and the back plate 202. In this way, the front plate 201 and the back plate 202 may be coupled to the first box part 100 in a substantially fixed position via contact with the first lid walls 102A, 102B, while still allowing the latch 104 to slide within the apertures 103, 203, 204. Further, the front plate 201 may be substantially hidden from view by virtue of being within the outside wall 102A.

In an alternative example, the latch 104 may include the slide flange 206 as discussed above, and the slide flange 206 may be disposed between the inside wall 102A and the outside wall 102B. This may allow the latch 104 to slide laterally within the aperture 103. Further this configuration may also allow the latch 104 to resist sagittal movements that might otherwise cause the latch 104 to fall out of (or into) the first lid wall 102. Other configurations and arrangements for keeping the latch 104 disposed within the aperture 103 are also possible, including one, both, or neither of the front plate 201 and the back plate 202.

In some implementations, the latch 104 may include at least one notch sized to engage at least one protrusion of the first lid wall 102. In FIG. 2B, four notches 207A-207D are shown on the slide flange 206. The notches may be located elsewhere on the latch 104 as well and may further be included on an example latch that does not include a slide flange 206. Additionally, the back plate 202 in FIG. 2B includes four protrusions 208A-208D. The protrusions may alternatively or additionally be located on the front plate 201. Further, in an example that does not include a front plate 201 or a back plate 202, the protrusions may be located elsewhere on the first lid wall 102, perhaps on the outer wall 102A or the inner wall 102B. More or less protrusions and notches are possible. Further, the protrusion(s) may alternatively be located on the latch 104, and the notch(es) located on the first lid wall 102. Or there may be a combination of notches and/or latches on one or both parts. Other examples are also possible.

The opposing notches and protrusions, when engaged, may serve to resist (but not entirely prevent) the sliding of the latch 104 when it is in certain positions within the aperture 103. As seen in FIG. 2B, two of the notches 207C-207D and two of the protrusions 208C-208D may be engaged when the latch 104 is in the second position, at the left side of the aperture 103. This may be the "locked" position. This arrangement may serve to maintain the latch 104 in the second, "locked" position such that it cannot freely slide into an "unlocked" position. The latch 104 may be slid out of the second position by applying a minimal force to the latch 104 to overcome the resistance caused by the notches and protrusions.

Accordingly, sliding the latch within the aperture at block 604 of the method 600 may involve sliding the latch such that at least one notch located on the latch engages at least one protrusion of the first lid wall.

Additionally or alternatively, the notches and protrusions might be configured such that they are engaged when the latch 104 is in the first position within the aperture 103. For example, two of the notches 207A-207B and two of the protrusions 208A-208B may be engaged when the latch 104 is, at the right side of the aperture 103 as shown in FIG. 2B. This may be the "unlocked" position. This arrangement may serve to keep the latch 104 generally aligned with the assembly channel segment 107 for greater ease of fitting the box parts together. Again, the latch 104 may be slid out of the first position by applying a relatively minimal force to the latch 104 to overcome the resistance caused by the notches and protrusions.

In some examples, the first tray wall 105 may include a channel liner that is coupled to the first tray wall 105 to facilitate the sliding of the latch 104 within the channel 106. FIGS. 2A and 2B show an example channel liner 205, which is configured to follow the shape of both the assembly channel segment 107 and the locking channel segment 108. Further, the channel liner 205 may include a relatively greater width at its top, as shown in FIG. 2B, where its width may correspond to the widened top of the assembly channel segment 107.

Further, the first tray wall 105 may consist of two or more adjacent walls, such as the inner wall 105A and the outer wall 105B. The channel liner 205 may be include a positioning flange 209 that is disposed between the inner wall 105A and the outer wall 105B, as shown in FIG. 2A. This arrangement may serve to couple the channel liner 205 to the first tray wall 105 and hold the channel liner 205 in place. In other examples, the channel liner 205 may consist of a front plate and a back plate that may be coupled together in a way that further couples them to the second box part 101, as discussed above with respect to the front plate 201 and back plate 202.

In some examples, the latch 104 may include an interior flange that is disposed within the first tray wall 105 when the second box part 101 is fitted within the first box part 100.

FIGS. 2A and 2B show an example of the interior flange 210, which is disposed on the inside of the inner wall 105A. The interior flange 210 may serve to maintain the position of the latch 104 within the apertures 103, 203, 204 while still allowing the latch to slide laterally within the apertures 103, 203, 204. The interior flange 210 may be included on the latch 104 in addition to, or instead of, the slide flange 206.

In some example packaging systems, a first box part may include more than one latch as discussed above, and a second box part may include more than one channel sized to receive each respective latch. For instance, a pair of latches may be positioned on the farthest ends of a cuboid shape that has length greater than its height or width. Other arrangements and configurations are also possible.

Returning to FIG. 1A, it may be assumed for purposes of explanation that the side of the first box part 100 opposite the first lid wall 102 includes a second aperture and latch, and that the second box part 101 includes a corresponding channel on the wall opposite the first tray wall 105. In such an arrangement, it may be desirable to configure the latches (and the corresponding channels) such that the latches slide in the same relative direction to the "locked" or "unlocked" position within their respective apertures. Thus, a person with the example packaging system in front of them might slide both latches forward (away from the person) to "unlock" the latches, and back (toward the person) to "lock" the latches.

Figure 3:
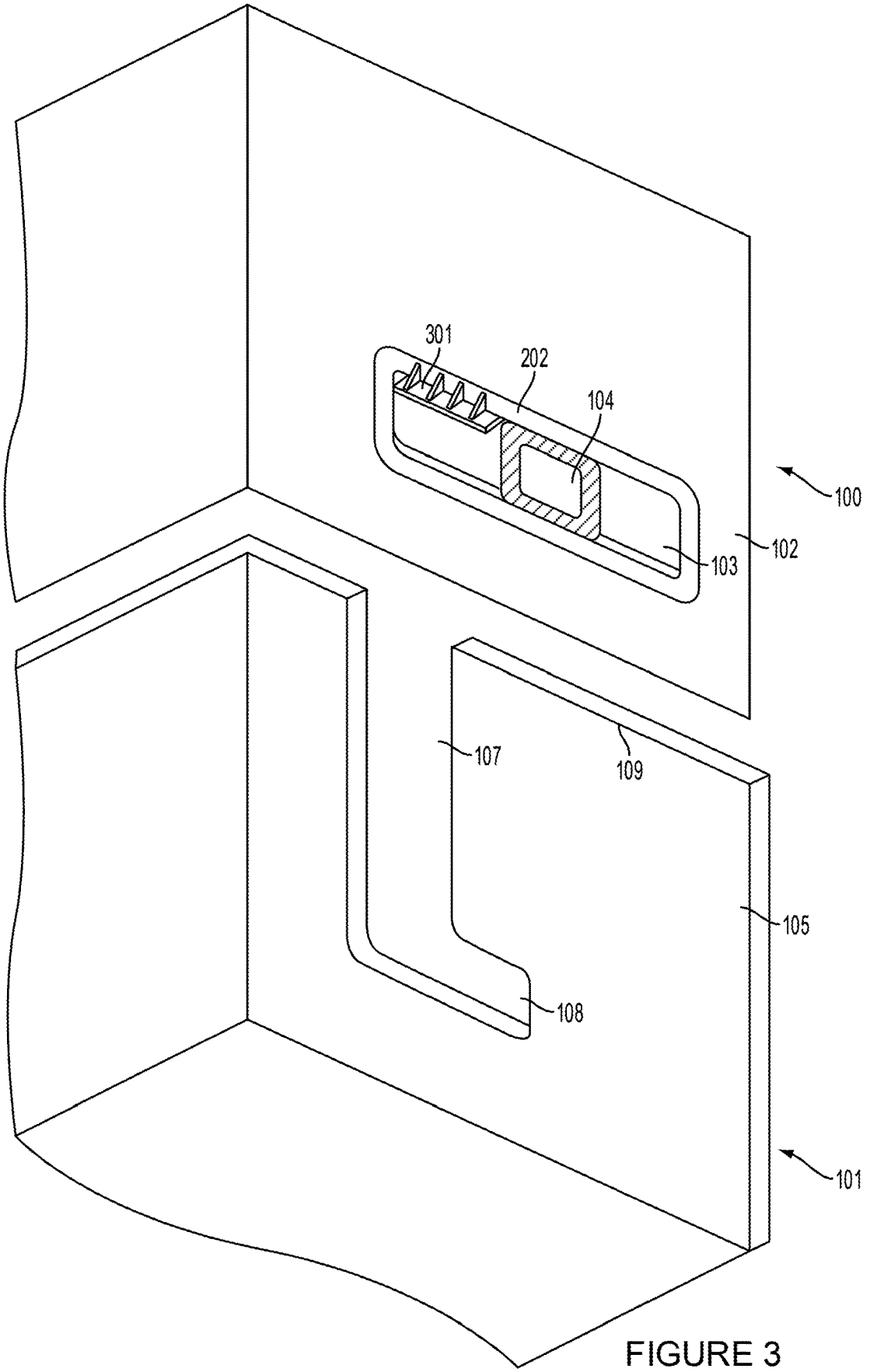
FIG. 3 shows a packaging system according to an example implementation.

In some examples, the first lid wall may include a guide projection positioned such that the guide projection aligns with the assembly channel segment when the second box part is fitted within the first box part. This may be used to help avoid ambiguity in the alignment of the first and second box parts in an example packaging system that has multiple latches. FIG. 3 shows an interior view of the first box part 100 and the second box part 101, with some lid walls and tray walls not shown for clarity. A guide projection 301 is shown on the interior of the first lid wall 102, positioned such that it is aligned with the assembly channel segment 107 of the first tray wall 105. To better show the guide projection 301 in FIG. 3, the latch 104 is shown in an intermediate position within the aperture 103. However, it should be recognized that that latch 104 would have to be moved to the left (i.e., to the "unlocked" position), under the guide projection 301 in order for the box parts to be fitted together.

In FIG. 3, the guide projection is shown as part of the back plate 202, although other examples are also possible. In an implementation of the first lid wall 105 that does not include a back plate 202, the guide projection may be coupled to a different component of the first lid wall 105. Other possibilities also exist.

II. Assembly of Example Packaging Systems

In some implementations, assembling a packaging system may involve forming a first and second blank for respective first and second box parts, disposing a latch within an aperture of the first blank, and assembling the first and second box parts from the first and second blanks.

For example, at block 702, the method 700 may involve preparing a first blank for a first box part. The first blank may be a flat and relatively featureless sheet of paper, paperboard, cardboard, fiberboard, or the like. It may be corrugated, uncorrugated, or a combination thereof. The first blank may alternatively be plastic. Other examples are also possible.

Preparing the first blank may involve cutting the first blank into a predetermined shape and scoring the first blank with lines along which the first blank may be folded to form the first box part. FIG. 4 shows an example of a first blank 400 that may be formed into a first box part that is cuboid in shape and includes five lid walls. The first blank 400 is cut along lines 401A-401F and scored along lines 402A-402F. In some examples, as discussed above, one or more of the lid walls of the first box part may include a pair of adjacent walls. Accordingly, the first blank may include a pair of walls 403A, 403B that, when folded onto one another along line 402B, form a first lid wall of the first box part. Other examples, including a different shape or number of walls, are also possible.

One or more apertures may be cut into the first blank as well. As shown in FIG. 4, the pair of walls 403A, 403B that may form the first lid wall each include an aperture 404A, 404B. The apertures 404A, 404B may be folded together along line 402B, as noted above. Further, the first blank 400 shown in FIG. 4 may be formed into a first box part that includes two apertures on opposing lid walls. Preparing the first blank may also involve printing logos, product information, and the like onto the blank. Other possibilities also exist.

At block 704, the method 700 may involve preparing a second blank for a second box part. The preparation of the second blank may be largely similar to the preparation of the first blank as discussed above. FIG. 5 shows a second blank 500 that is cut along lines 501A-D and scored along lines 502A-H. The second blank 500 may then be folded along lines 502A-H to form five tray walls of a second box part. Like the first blank 400, the second blank 500 includes several pairs of walls, such as walls 503A, 503B that may by folded onto one another to form a first tray wall of the second box part.

Preparation of the second blank 500 may further include cutting one or more channels into the second blank 500 that are sized to slidably receive a latch, as discussed above with reference to FIGS. 1A-2B. FIG. 5 shows a cut-out 504 that may form a channel in the first tray wall when walls 503A, 503B are folded onto one another along line 502H. The channel further may include an assembly channel segment and a locking channel segment, as discussed above.

At block 706, the method 700 may involve disposing the latch within the aperture such that the latch is slidable within the aperture. FIG. 4 shows a latch 405 disposed within the aperture 404A. In some examples, the latch 405 may alternatively be disposed with the aperture 404B, as the two apertures 404A, 404B will ultimately be adjacent to one another. Other examples are also possible.

Disposing the latch 405 within the aperture 404A may further involve coupling a front plate and a back plate as discussed above to one or both of the pair of walls 403A, 403B that will be the first lid wall. Other steps may also be performed at block 706, such as coupling one or more fasteners to the first blank 400 that may facilitate forming the first box part. Other examples are also possible. Further, block 706 or an additional block in the method 700 may separately involve coupling a channel liner to the second blank 500. Other components may also be added, such as fasteners that may facilitate forming the second box part.

At block 708, the method 700 may involve forming the first box part from the first blank. This may include folding the first blank 400 along the scored lines 402A-402F and substantially fixing the plurality of lid walls in place by, for example, tucking one or more flaps, such as the flap 406, into one or more slots formed by the folded portions of the first blank. Forming the first box part may further involve gluing portions of one ore more lid walls together, or fastening one or more fasteners that may have been added to the first blank before the first box part was formed. Other possibilities exist.

In some examples, disposing the latch 405 within the aperture 404A at block 706 may occur before the first box part is assembled at block 708. Alternatively, disposing the latch 405 within the aperture 404A may occur after the assembly of the first box part. Similarly, coupling a channel liner to the second blank to the second blank 500 may occur either before or after assembling the second box part, which is discussed below at block 710. Additional examples are also possible.

At block 710, the method 700 may involve forming the second box part from the second blank, which may include one or more of the actions just discussed with respect to the first box part. For example, the second blank 500 may be folded along the scored lines 502A-502H and flaps, such as flap 505, may be tucked into slots created by the folded portions of the second blank 500 to substantially fix the tray walls in place. Further, the second box part may be formed to fit within the first box part such that the assembly and locking channel segments are aligned with the latch and aperture as discussed above with respect to FIGS. 1A-2B.

IV. Conclusion

As indicated above, the examples involve packaging systems including a sliding latch. In one aspect, a packaging system is provided. The packaging system includes 1) a first box part including a plurality of lid walls, where a first lid wall includes an aperture; 2) a latch slidably disposed within the aperture; and 3) a second box part including a plurality of tray walls, where a first tray wall includes a channel sized to slidably receive the latch, where the channel includes an assembly channel segment and a locking channel segment, where the assembly channel segment intersects an edge of the first tray wall, where the second box part is configured to fit within the first box part such that a) the assembly channel segment is aligned with the latch when the latch is in a first position within the aperture, and b) the latch is slidable within the locking channel segment to a second position.

In another aspect, a method is provided. The method involves 1) fitting a second box part within a first box part, where the first box part includes a plurality of lid walls, where a first lid wall includes an aperture, where a latch is slidably disposed within the aperture, where the second box part includes a plurality of tray walls, where a first tray wall includes a channel sized to slidably receive the latch, where the channel includes an assembly channel segment and a locking channel segment, where the assembly channel segment intersects an edge of the first tray wall, and where the second box part is configured to fit within the first box part such that a) the assembly channel segment is aligned with the latch when the latch is in a first position within the aperture, and b) the latch is slidable within the locking channel segment to a second position; and 2) sliding the latch within the aperture to the second position, where sliding the latch within the aperture further includes sliding the latch within the locking channel segment.

In yet another aspect, a method is provided. The method involves 1) preparing a first blank for a first box part, the first box part including a plurality of lid walls, where a first lid wall includes an aperture; 2) preparing a second blank for a second box part, the second box part including a plurality of tray walls, where a first tray wall includes a channel sized to slidably receive the latch, where the channel includes an assembly channel segment and a locking channel segment, where the assembly channel segment intersects an edge of the first tray wall; 3) disposing a latch within the aperture such that the latch is slidable within the aperture; 4) forming the first box part from the first blank; and 5) forming the second box part from the second blank, where the formed second box part is configured to fit within the formed first box part such that a) the assembly channel segment is aligned with the latch when the latch is in a first position within the aperture, and 2) the latch is slidable within the locking channel segment to a second position.

It will be understood by one of ordinary skill in the art that this disclosure includes numerous other implementations. While some examples described herein may refer to functions performed by given actors such as "users" and/or other entities, it should be understood that this description is for purposes of explanation only. The claims should not be interpreted to require action by any such example actor unless explicitly required by the language of the claims themselves.

Additionally, references herein to "embodiment" means that a particular feature, structure, or characteristic described in connection with the embodiment can be included in at least one example embodiment of an invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative implementations, devices, systems, procedures, and steps. These descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, and components, have not been described in detail to avoid unnecessarily obscuring aspects of the embodiments. Accordingly, the scope of the present disclosure is defined by the appended claims rather than the forgoing description of embodiments.

We claim:

1. A packaging system comprising:

a first box part comprising a first lid wall, the first lid wall comprising an aperture;

a latch disposed within the aperture and slidable within the aperture in a direction parallel to the first lid wall, the latch comprising a body portion that extends perpendicularly into the first box part; and a second box part comprising a first tray wall, the first tray wall comprising a channel sized to slidably receive the latch, the channel including an assembly channel segment and a locking channel segment, and wherein, when the first box part and the second box part are fitted together:

a) the latch is slidable, in the direction parallel to the first lid wall and within the locking channel segment, to a first position that is aligned with the assembly channel segment, such that the latch is slidable within the assembly channel segment when separating the first box part and the second box part, and b) the latch is slidable, in the direction parallel to the first lid wall and within the locking channel segment, to a second position.

2. The packaging system of claim 1, wherein the latch comprises a slide flange substantially parallel to the first lid wall.

3. The packaging system of claim 2, wherein the first lid wall comprises two adjacent walls, and wherein the slide flange is slidably disposed between the two adjacent walls of the first lid wall.

4. The packaging system of claim 2, wherein the first lid wall further comprises a plate substantially parallel with the first lid wall, wherein the plate comprises an aperture that is substantially aligned with the aperture of the first lid wall, and wherein the slide flange is slidably contained within the first lid wall by the plate.

5. The packaging system of claim 4, wherein the plate is a back plate, wherein the first lid wall further comprises a front plate, wherein the front plate comprises an aperture, wherein the front plate and the back plate are coupled together such that the apertures of a) the first lid wall, b) the front plate, and c) the back plate are substantially aligned, and wherein the slide flange is slidably contained within a cavity between the front plate and the back plate.

6. The packaging system of claim 1, wherein the latch further comprises at least one notch sized to engage at least one protrusion of the first lid wall, wherein the at least one notch and the at least one protrusion are engaged when the latch is in the second position.

7. The packaging system of claim 6, wherein the at least one notch and the at least one protrusion are also engaged when the latch is in the first position.

8. The packaging system of claim 1, wherein the latch is slidable within the aperture along a single axis.

9. The packaging system of claim 1, wherein the latch comprises a body portion that extends perpendicularly into the first box part, and wherein the latch is slidable within the locking channel segment to the second position such that the body portion of the latch resists separation of the first box part and the second box part via contact with the locking channel segment.

10. A package comprising:

a first box part comprising a first lid wall, the first lid wall comprising an aperture and a latch slidably disposed within the aperture;

a second box part comprising a first tray wall, the first box part and the second box part together forming the package, wherein the first tray wall comprises a channel sized to receive the latch, wherein the channel includes an assembly channel segment and a locking channel segment, and wherein the locking channel segment is aligned with the aperture of the first lid wall; and the latch slidably disposed in a locked position within the aperture and the locking channel segment, wherein, when the latch is slid within the aperture and the locking channel segment in a direction parallel to the first lid wall to an unlocked position, the latch is aligned with the assembly channel segment such that the latch is slidable within the assembly channel segment when separating the first box part and the second box part.

11. The package of claim 10, wherein the latch comprises a slide flange substantially parallel to the first lid wall.

12. The package of claim 11, wherein the first lid wall comprises two adjacent walls, and wherein the slide flange is slidably disposed between the two adjacent walls of the first lid wall.

13. The package of claim 11, wherein the first lid wall further comprises a plate substantially parallel with the first lid wall, wherein the plate comprises an aperture that is substantially aligned with the aperture of the first lid wall, and wherein the slide flange is slidably contained within the first lid wall by the plate.

14. The package of claim 13, wherein the plate is a back plate, wherein the first lid wall further comprises a front plate, wherein the front plate comprises an aperture, wherein the front plate and the back plate are coupled together such that the apertures of a) the first lid wall, b) the front plate, and c) the back plate are substantially aligned, and wherein the slide flange is slidably contained within a cavity between the front plate and the back plate.

15. The package of claim 10, wherein the latch further comprises at least one notch engaged with at least one protrusion of the first lid wall.

16. The package of claim 15, wherein the at least one notch and the at least one protrusion are further engaged when the latch is in the unlocked position within the aperture and the locking channel segment.

17. The package of claim 10, wherein the latch comprises a body portion that extends perpendicularly into the first box part and the second box part such that the body portion of the latch resists separation of the first box part and the second box part via contact with the locking channel segment.

18. The package of claim 17, wherein, when the latch is slid in the direction parallel to the first lid wall to the unlocked position, the body portion of the latch is slidable within the assembly channel segment such that the first box part and the second box part are separable.

* * * * *